US006648325B1

(12) United States Patent
Mays et al.

(10) Patent No.: US 6,648,325 B1
(45) Date of Patent: Nov. 18, 2003

(54) COMPACT STACKER MECHANISM

(75) Inventors: David S. Mays, Solon, OH (US); Martin D. Lingo, Streetsborow, OH (US)

(73) Assignee: Pyramid Technologies, Oakwood Village, OH (US)

( * ) Notice: Subject to any disclaimer, the term of this patent is extended or adjusted under 35 U.S.C. 154(b) by 77 days.

(21) Appl. No.: 10/078,559

(22) Filed: Feb. 15, 2002

(51) Int. Cl.[7] ..... B65H 29/38
(52) U.S. Cl. ..... 271/177
(58) Field of Search ..... 271/177, 180, 271/181; B65H 29/38, 29/44, 29/46

(56) References Cited

U.S. PATENT DOCUMENTS 4,678,072 A 7/1987 Kobayashi et al.
5,209,395 A * 5/1993 Zouzoulas et al. ..... 232/15
5,388,817 A 2/1995 Chang
5,641,157 A 6/1997 Mays et al.
5,730,271 A * 3/1998 Buchman et al. ..... 194/206
5,899,452 A 5/1999 Walsh
6,546,881 B1 * 4/2003 Wiesner ..... 109/45

* cited by examiner

*Primary Examiner*—Donald P. Walsh
*Assistant Examiner*—Kenneth W Bower
(74) *Attorney, Agent, or Firm*—Knobbe, Martens, Olson & Bear, LLP

(57) ABSTRACT

A note stacker mechanism having a rotary motor with a shaft, a crank arm mounted onto the motor shaft, and a telescoping drive mechanism actuated by the crank arm for pushing a bank note into a storage box. Simplicity of design results in a low cost, compact stacker mechanism.

42 Claims, 6 Drawing Sheets

COMPACT STACKER MECHANISM

BACKGROUND

1. Field of the Invention

The invention relates generally to devices for validating and storing currency, and more specifically to stacker mechanisms used in such devices.

2. Description of the Related Technology

A currency validator generally comprises multiple mechanisms to transport, validate, and store commercial paper such as bank notes. Once introduced into the currency validator, the bank note is transported past a variety of sensors to determine the validity of the note. After the note is validated it is typically transferred into a storage box by a stacker mechanism. These general concepts are discussed in the literature, e.g., U.S. Pat. Nos. 4,678,072, 5,388,817, 5,899,452 and 5,641,157.

For convenience, the terms "currency validator" and "note validator" may be used interchangeably. As used here, the term "note" is meant to encompass a variety of commercial papers that are received by a currency validator. For example, a "note" is typically a bank note such as paper currency. The relevant technology, however, is not limited to the receipt of notes; rather, the technology may be applied to devices for receiving and stacking items such as a store coupon having a designated arbitrary value, or any other paper documents to be collected, validated, and/or stored.

Where a compact stacker mechanism is desired, conventionally a stacker mechanism consisting of a complex scissors type assembly is typically utilized. However, these mechanisms sacrifice simplicity for compactness. An example of this type of stacker mechanism is shown in U.S. Pat. No. 4,678,072.

Stacker mechanisms which do not rely on the scissors type assembly may utilize fewer parts but lose compactness. For example, some stacker mechanisms include a pusher assembly for pushing the note into a storage box. However, for stability purposes the pusher assembly must be long enough to extend as far as required to correctly place the note into the storage box and at the same time remain engaged in a guiding mechanism. Therefore, devices using the pusher assembly generally must be of considerable length.

Consequently, there is a need in the industry for a stacker mechanism that has fewer moving parts while at the same time providing compactness.

SUMMARY OF CERTAIN INVENTIVE EMBODIMENTS

The stacker mechanism and associated methods of the present invention have several aspects, no single one of which is solely responsible for its desirable attributes. Without limiting the scope of the invention as expressed by the claims, its more prominent features will now be discussed briefly.

In one embodiment, the invention relates to an apparatus for stacking a note in a note validator that has a storage box. The apparatus comprises a motor that has a rotary shaft and a crank arm that couples to the shaft. The apparatus further comprises a telescoping drive member configured to engage with the crank arm such that the crank arm causes the telescoping drive member to move linearly in a plane perpendicular to the longitudinal axis of the shaft. The apparatus further comprises a pusher plate directly actuated by the telescoping drive member for pushing the note into the storage box Another aspect of the invention relates to an apparatus for stacking and storing bank notes. The apparatus comprises a removable storage box for storing the bank notes. The storage box may include a unshaped housing, flanges attached to the housing, and a spring loaded counter-pressure plate. The apparatus further comprises a crank arm affixed to a rotary motor and a telescoping drive member. The apparatus may further comprise a crank arm for directly actuating the telescoping drive member. The apparatus further may comprise a pusher plate, attached to the telescoping drive member, for pushing the bank notes into the storage box.

In yet another embodiment, the invention relates to an apparatus for stacking a note in a note validator having a storage box. The apparatus comprises a motor having a rotary shaft, a crank arm coupled to the shaft, wherein the crank arm is configured with a protruding member. The apparatus may further comprise a telescoping drive member having a proximal end, an intermediate portion, and a distal end, wherein the proximal end comprises a groove for receiving the protruding member. The apparatus may further comprise a plate coupled to the distal end, wherein the plate and the telescoping drive member are positioned substantially perpendicular to one another, and wherein the crank arm causes the telescoping drive member to move linearly in a plane perpendicular to the longitudinal axis of the shaft. In this embodiment, the telescoping drive member is configured to move the plate for pushing the note into the storage box.

Yet another aspect of the invention relates to an apparatus for stacking bank notes in a note validator that has a frame and a storage box. The apparatus may comprise a motor having a rotary shaft that is coupled to a crank arm, which is configured with a protruding member. The apparatus may further comprise a telescoping drive member having a proximal end, an intermediate portion, and a distal end. The proximal end of the telescoping drive member may contain a first groove for receiving the protruding member, and the first groove may be perpendicular to a line defined by the shortest distance between the proximal end and the distal end. The telescoping drive member may contain a second groove that runs substantially from the proximal end to the distal end. The apparatus may further comprise a support member, substantially located inside the frame, having at least one rail configured to couple with the second groove for supporting and guiding the telescoping drive member. The apparatus may further comprise a plate coupled to the distal end, wherein the plate and the telescoping drive member are positioned substantially perpendicular to one another. The crank arm is configured to cause the telescoping drive member to move linearly in a plane perpendicular to the longitudinal axis of the shaft, and the telescoping drive member is configured to move the plate for pushing the note into the storage box.

In another embodiment the invention relates to an apparatus for stacking bank notes in a bank note validator that has a storage box. The apparatus comprises means for rotating a shaft, and means coupled to the shaft for converting the circular motion of the shaft to reciprocating linear motion. The apparatus may further comprise telescoping drive means configured to engage with the means for converting, such that the means for converting causes the telescoping drive means to move linearly in a plane perpendicular to the longitudinal axis of the shaft. The apparatus may further comprise means directly actuated by the telescoping means for pushing the note into the storage box.

Various details of certain inventive embodiments are set forth in the following description and in the accompanying drawings.

BRIEF DESCRIPTION OF THE DRAWINGS

The above and other aspects, features, and advantages of the invention will be better understood by referring to the following detailed description, which should be read in conjunction with the accompanying drawings, in which:

FIG. 3 shows the stacker mechanism of FIG. 1.

FIG. 4A shows the stacker mechanism in the retracted position.

FIG. 5A shows the stacker mechanism partly displaced from its retracted position during operation.

FIG. 5B shows the stacker mechanism further along its displacement path relative to the view illustrated in FIG. 5A.

FIG. 6A shows the stacker mechanism at full extension during operation.

DETAILED DESCRIPTION OF CERTAIN INVENTIVE EMBODIMENTS

The following detailed description is directed to certain specific embodiments of the invention. However, the invention can be embodied in a multitude of different ways as defined and covered by the claims. In this description, reference is made to the drawings wherein like parts are designated with like numerals throughout.

Figure 1:
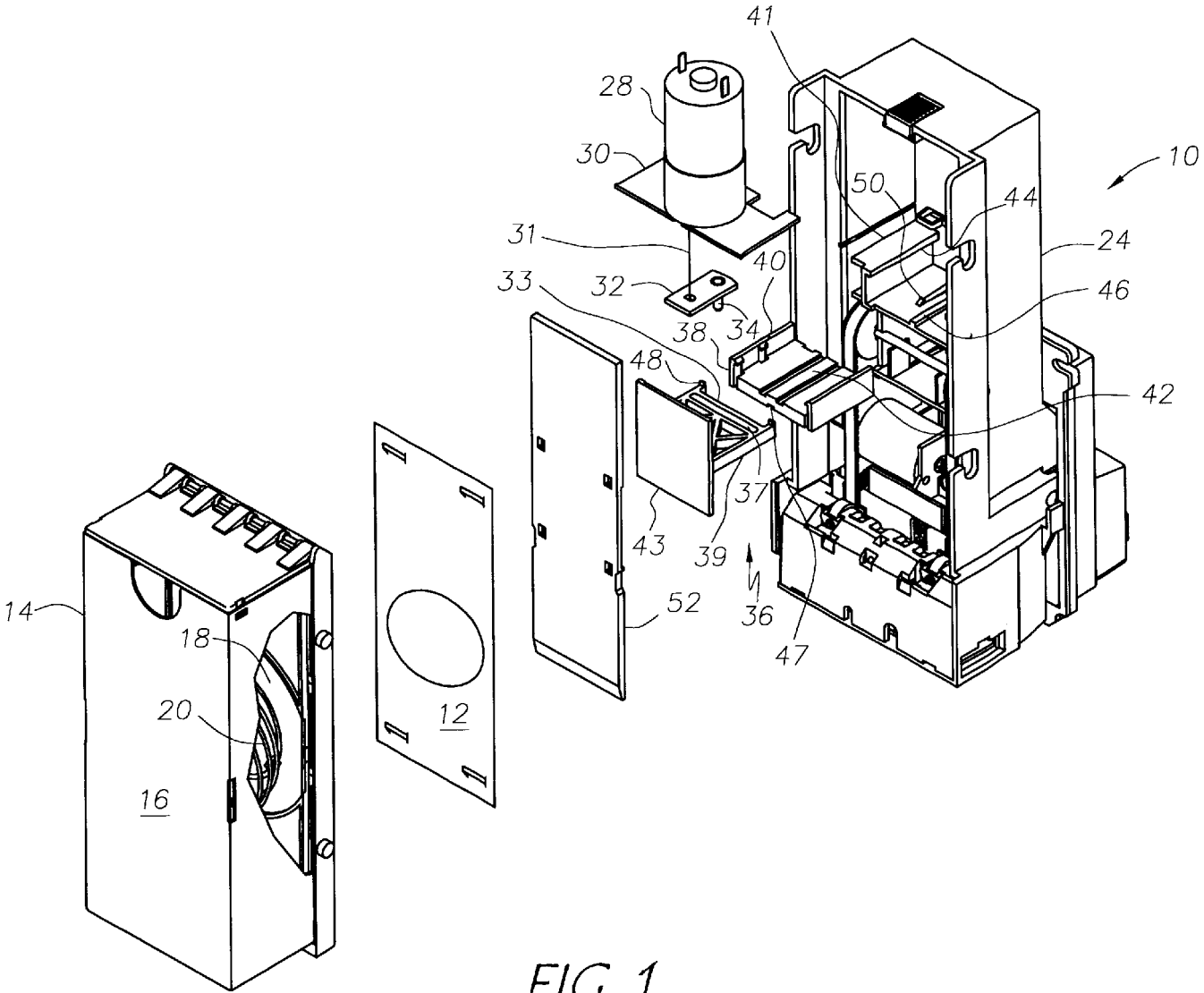
FIG. 1 is an exploded view of a note validator having a stacker mechanism according to one embodiment of the invention.

FIG. 1 shows a note validator 10 for validation and storage of a note 12, in accordance with one embodiment of the invention. FIG. 1 shows only as much of the validator 10 as is necessary to explain the invention. The validator 10 may include a removable storage box 14 that attaches to a validator frame 24. The validator 10 further includes a stacker mechanism that generally may include a motor 28, a crank arm 32 having a pin 34, a telescoping drive member 36, a telescoping support member 38, and a fixed support member 41. FIGS. 3 through 6B, discussed in detail below, provide cross-sectional plan and side views of the components and operation of the stacker mechanism.

Figure 2:
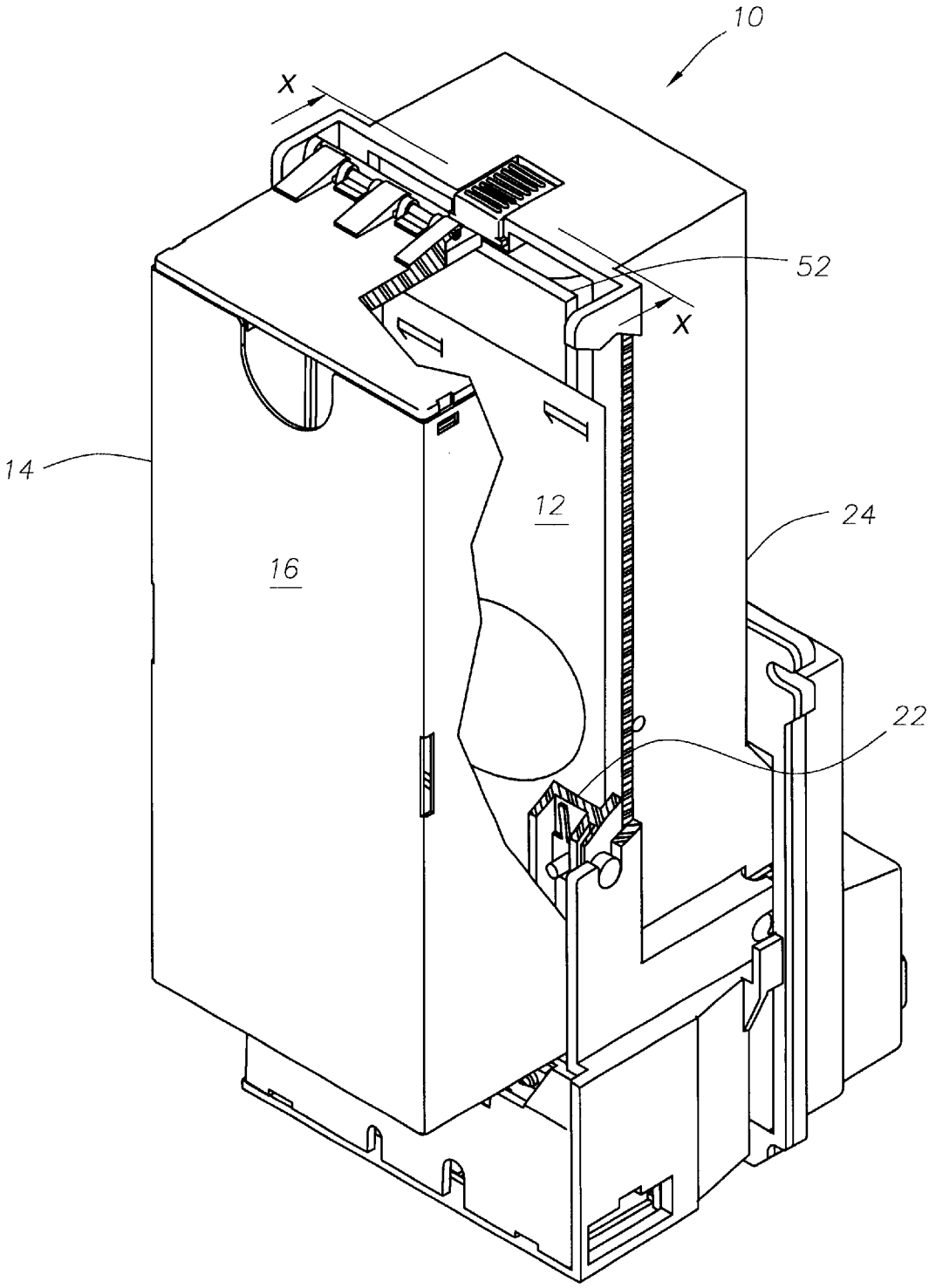
FIG. 2 is an assembled view of the note validator of FIG. 1 showing a note in position for stacking into a storage box.

FIG. 2 shows the validator 10 of FIG. 1 in an assembled form, with a note 12 in position for stacking into the storage box 14. As illustrated, the storage box 14 removably attaches to the validator frame 24. The note 12 is positioned between the flanges 22 and the pusher plate 52 (see FIG. 1) before the stacker mechanism pushes the note 12 into the storage box 14. The removable storage box 14 may include a u-shaped housing 16, a counter-pressure plate 18, and one or more compression springs 20 (see FIG. 1). The flanges 22 may be manufactured integral to the u-shaped housing 16 or may be separate parts added to it. Once the stacker mechanism pushes the note 12 into the storage box 14, the counter-pressure plate 18 presses the note 12 against the flanges 22 to hold the note 12 in place. When attached to the validator frame 24, the storage box 14, the flanges 22 and the validator frame 24 form a pathway 26 (see FIG. 4) in which the note 12 travels.

One embodiment of the stacker mechanism will now be described with reference to FIG. 1 and FIG. 3. The stacker mechanism may include an electric motor 28 attached to a mounting plate 30, which mounting plate 30 in turn mounts onto the validator frame 24. A crank arm 32 is affixed to a shaft 31 of the motor 28. In FIG. 1, the motor shaft 31 is shown diagrammatically as a line connecting the motor 28 and the crank arm 32; the shaft 31 is more clearly shown in FIGS. 4B and 6B. A pin 34 is coupled to the crank arm 32 for fitting into a groove 37 formed in a proximal end 33 of the telescoping drive member 36.

The telescoping drive member 36 may include an intermediate portion 39 having support ribs coupled to the groove 37. The intermediate portion 39 may also be coupled to a distal end 43 of the telescoping drive member 36. In one embodiment, the distal end 43 may be in the form of a drive plate, which may be a substantially square plate positioned substantially perpendicular to the telescoping drive member 36 (see FIG. 1). In one embodiment, the telescoping drive member 36 rests on, and engages with, a telescoping support member 38. The telescoping support member 38 may itself rest on, and engage with, a fixed support member 41 positioned within the validator frame 24. In one embodiment, the telescoping drive member 36 is affixed to a pusher plate 52, which extends the surface area that contacts the note 12. The broader surface area of the pusher plate 52 ensures that the note 12 is transferred with uniform force across its surface into the storage box 14. A skilled technologist will recognize that the telescoping drive member 36 and the pusher plate 52 may be manufactured as an integral piece, or as separate parts as shown in FIG. 1.

During operation of the stacker mechanism, the crank arm 32 converts the rotary motion of the shaft 31 into reciprocating linear motion perpendicular to the axis of the shaft 31. With each revolution of the shaft 31, the pin 34 first moves the telescoping drive member 36 against the note 12 and then pulls it back into the validator frame 24. When the telescoping drive member 36 moves out a certain distance from the validator frame 24, the fingers 48 on the rear of the telescoping drive member 36 engage the fingers 40 of the telescoping support member 38. Hence, the telescoping drive member 36 pushes the telescoping support member 38 away from the validator frame 24 because the fingers 48 of the telescoping drive member 36 push the telescoping support member 38 by the fingers 40 as the crank arm 32 pushes the telescoping drive member 36 away from the validator frame 24. In this manner, the telescoping drive member 36 is supported by the telescoping support member 38 as the telescoping drive member 36 extends outside the validator frame 24 (see FIG. 5B). After the crank arm 32 extends the telescoping drive member 36 fully (see FIG. 6B), the crank arm 32 begins to retract the telescoping drive member 36 back into the validator frame 24. After the crank arm 32 retracts the telescoping drive member 36 a certain distance, the telescoping drive member 36 butts up against the telescoping support member 38, pushing it back to a fully retracted position inside validator frame 24 (see FIG. 4B).

To provide stable and smooth movement of the stacker mechanism, in one embodiment the telescoping drive member 36 includes a groove 35 (see FIG. 3) for coupling to a rail 42, which may be made a part of the telescoping support member 38. The telescoping support member 38 may also be configured with a groove 47 for coupling to a rail 46, which may be part of the fixed support member 41. It will be apparent to technologists in the field that the telescoping support member 36 and the fixed support member 41 may be fitted with multiple rails 42 and 46 to correspondingly couple to multiple grooves 35 and 47.

In certain embodiments, the telescoping support member 38 is confined by wrap around fingers 44, which may be part of the fixed support member 41 (see FIG. 1). In one embodiment, if the telescoping support member 38 begins to move freely before the telescoping drive member 36 engages it, a stop finger 50 prevents the telescoping support member 38 from extending beyond a desired distance within the validator frame 24. The action of stop finger 50 ensures that frictional forces between the telescoping drive member 36 and the telescoping support member 38 do not cause these members to move in unison, which would result in the wobbling of the pusher 52 due to a reduction of the overall bearing surface supporting the pusher 52. The stop finger 50 may be part of the validator frame 24 or of the fixed support member 41.

Figure 3:
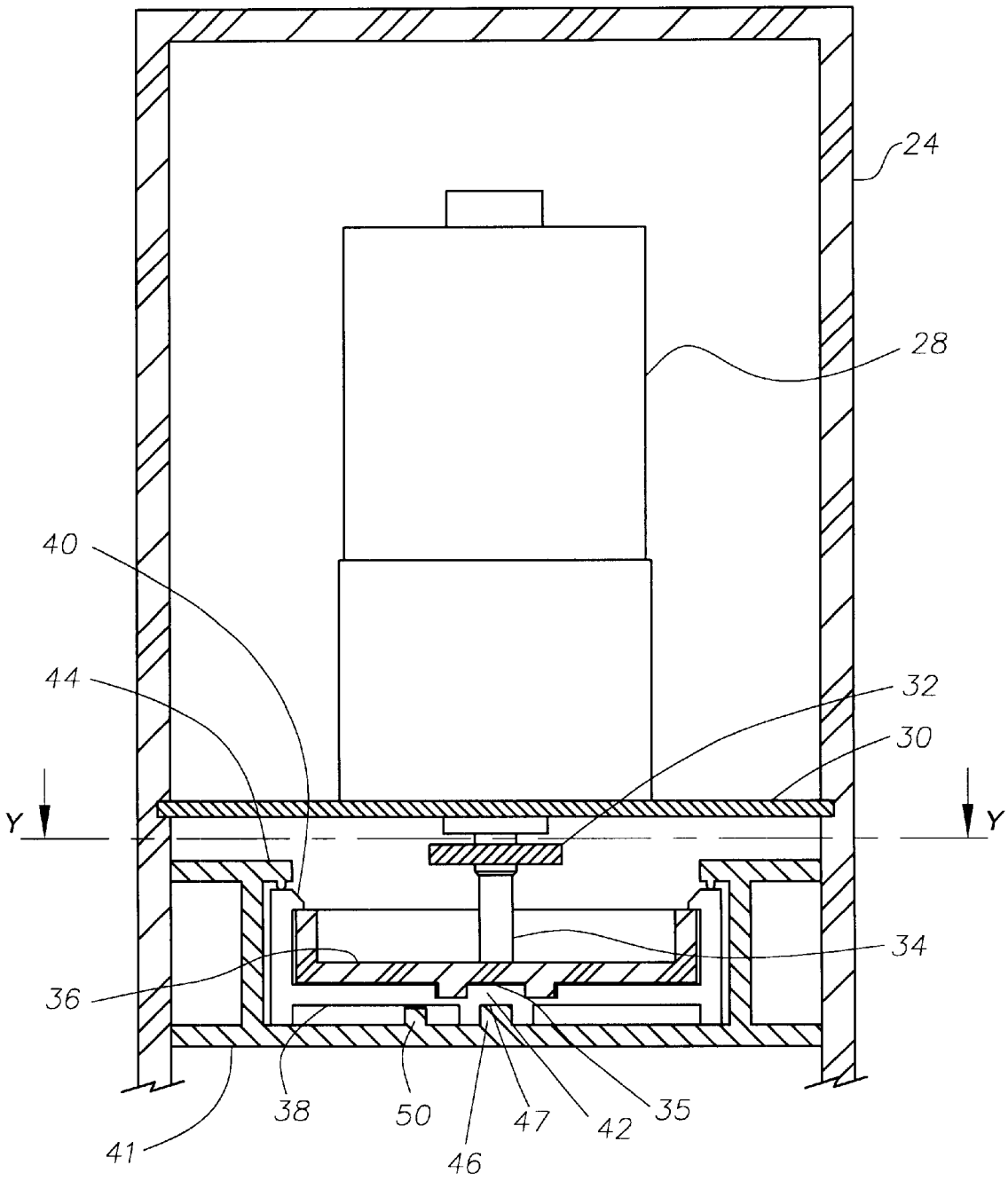
FIG. 3 is a cross-sectional view, defined by the line X—X, of the note validator of FIG. 2.

FIG. 3 illustrates that the telescoping drive member 36 is received within the telescoping support member 38, and that the telescoping support member 38 is received within the fixed support member 41. Also illustrated is the manner in which the rails 42 and 46 respectively engage the telescoping drive member 36 and the telescoping support member 38. As illustrated in FIG. 3, the wrap around fingers 44 may confine the telescoping support member 38 for providing stability to the stacker mechanism. Similarly, the fingers 40 of the telescoping support member 38 provide stability for the telescoping drive member 36 by confining it and allowing it to move only in the direction perpendicular to the path of the note 12 (see FIG. 5B).

Figure 4A:
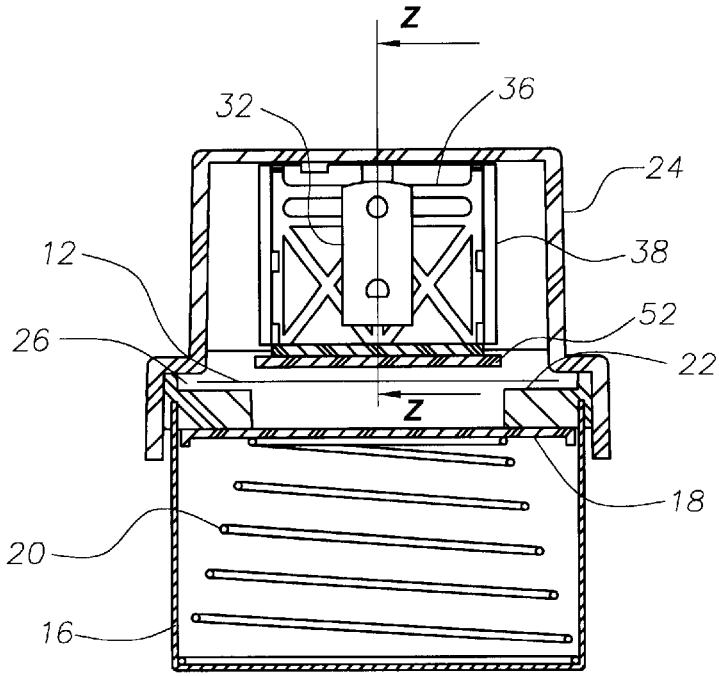
FIG. 4A is a cross-sectional plan view, defined by the line Y—Y, of the stacker mechanism of FIG. 3.
Figure 4B:
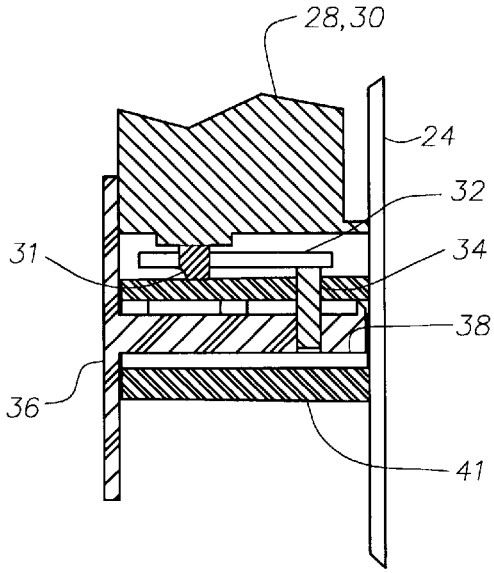
FIG. 4B is a cross-sectional elevational view, defined by line Z—Z of FIG. 4A, showing the stacker mechanism in the retracted position.
Figure 5A:
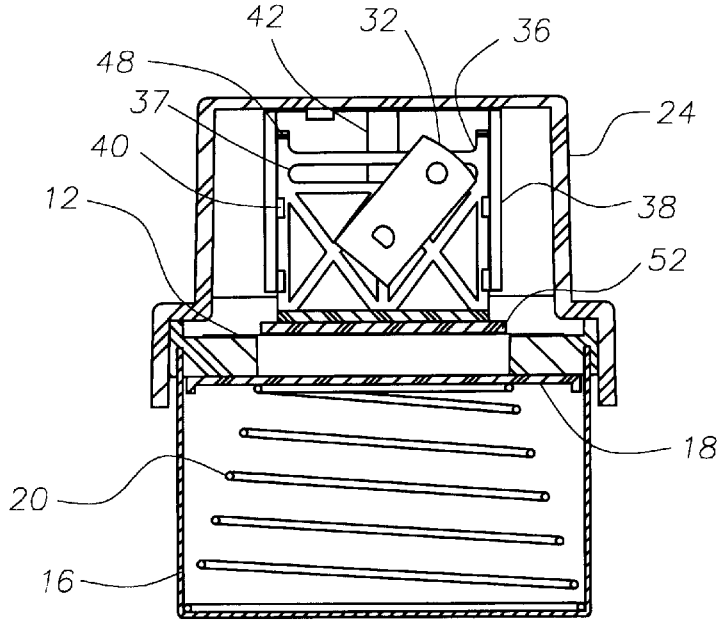
FIG. 5A is a cross-sectional plan view, defined by the line Y—Y, of the stacker mechanism of FIG. 3.
Figure 5B:
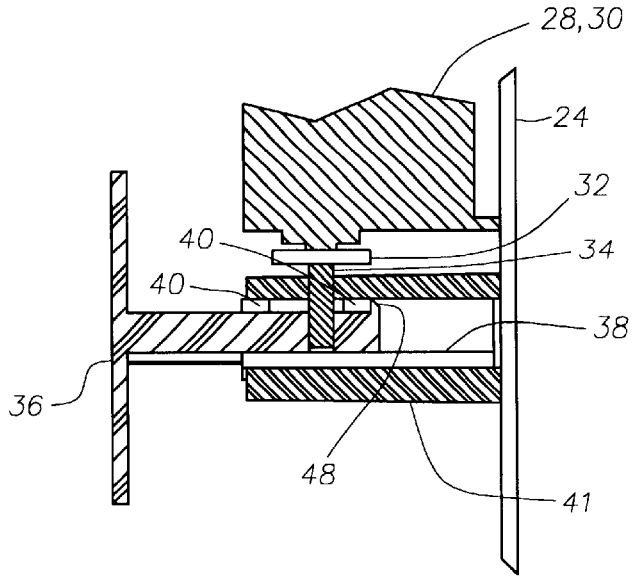
FIG. 5B is a cross-sectional sectional view showing a crank arm moving a drive member out of the frame of the note validator of FIG. 1.
Figure 6A:
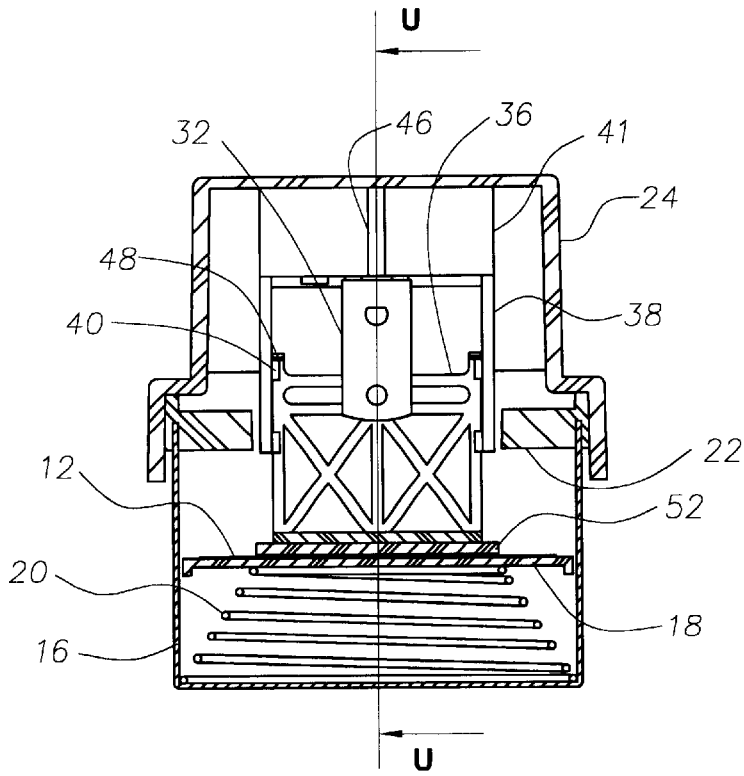
FIG. 6A is a cross-sectional plan view, defined by the Y—Y, of the stacker mechanism of FIG. 3.
Figure 6B:
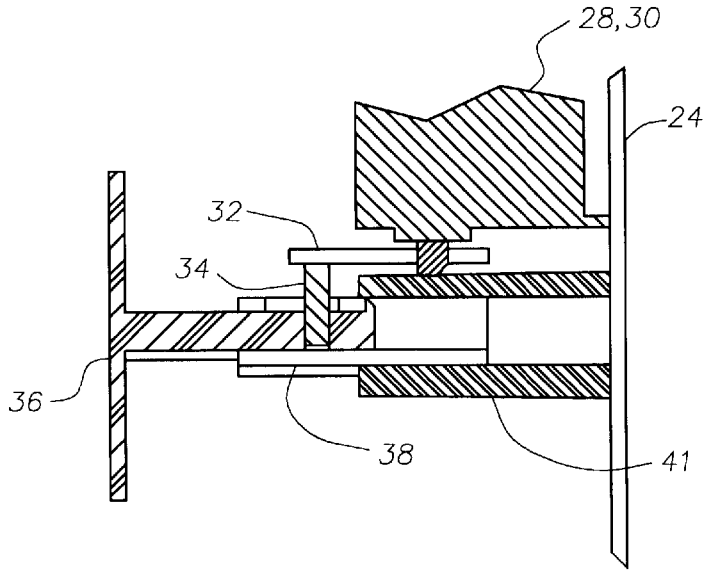
FIG. 6B is a cross-sectional view, defined by the line U—U of FIG. 6A, showing the stacker mechanism at full extension during operation.

FIGS. 4A through 6B illustrate various stages in the operation of the stacker mechanism. FIG. 4A depicts a note 12 at the staging area, as well as the stacker mechanism in the fully retracted position within the validator frame 24. FIG. 4B is a side elevational view, defined by the line Z—Z of FIG. 4A, of the stacker mechanism in the same position in the fully retracted position. FIG. 5A illustrates the extension of the telescoping drive member 36 as the pusher plate 52 contacts the note 12. FIG. 5B shows a side view of the stacker mechanism as it advances towards the storage box 14. FIG. 6A illustrates the telescoping drive member 36 and the telescoping support member 38 at full extension relative to the validator frame 24. FIG. 6B is a side elevational view, defined by the line U—U of FIG. 6A, of the stacker mechanism at full extension.

As depicted in FIG. 4B, 5B, and 6B, in one embodiment of the stacker mechanism, advantage is taken of the fact that the telescoping drive member 36 and the telescoping support member 38 are configured to provide compactness through their telescoping action. In addition, it will be apparent to a technologist that this embodiment of the stacker mechanism also takes advantage of the fact that the telescoping members 36 and 38 and support member 41 are "stacked" (or "nested") one on top of the other. This nesting arrangement of the telescoping drive member 36, telescoping support member 38, and fixed support member 41 increases the compactness of the stacker mechanism.

While the above detailed description has shown, described, and pointed out novel features of the invention as applied to various embodiments, it will be understood that various omissions, substitutions, and changes in the form and details of the device or process illustrated may be made by those skilled in the relevant technology without departing from the spirit of the invention. The scope of the invention is indicated by the appended claims rather than by the foregoing description. All changes which come within the meaning and range of equivalency of the claims are to be embraced within their scope.

What is claimed is:

1. An apparatus for stacking a note in a note validator having a storage box, the apparatus comprising:

a motor having a rotary shaft;

a crank arm coupled to the shaft;

a telescoping drive member configured to engage with the crank arm, wherein the crank arm causes the telescoping drive member to move linearly in a plane perpendicular to the longitudinal axis of the shaft; and a pusher plate directly actuated by the telescoping drive member for pushing the note into the storage box.

2. The apparatus of claim 1, wherein the telescoping drive member comprises at least two telescoping portions, and wherein at least one rail supports and guides at least one of the telescoping portions in one axis perpendicular to the axis of movement of the note.

3. The apparatus of claim 2, wherein the at least one rail is located on the center of the movement axis of the telescoping drive member.

4. The apparatus of claim 2, wherein the telescoping portions are configured with fingers for engaging one another and causing movement of at least one of the telescoping portions.

5. The apparatus of claim 4, wherein the fingers are further configured to confine movement of the telescoping portions to a plane perpendicular to the longitudinal axis of the shaft.

6. The apparatus of claim 1, further comprising a telescoping support member for supporting the telescoping drive member, wherein the telescoping drive member rides in the telescoping support member, and wherein the telescoping drive member engages with and pushes the telescoping support member after the crank arm moves the telescoping drive member a predetermined distance.

7. The apparatus of claim 6, further comprising a fixed support member attached to a validator frame of the validator, wherein the telescoping support member is configured to ride in the fixed support member.

8. The apparatus of claim 7, further comprising a stop finger attached to the fixed support member for limiting the distance of travel of the telescoping support member.

9. The apparatus of claim 1, wherein the telescoping drive member comprises a drive plate, and wherein the telescoping drive member actuates the pusher plate via the drive plate.

10. An apparatus for stacking and storing at least one note, the apparatus comprising:

a removable storage box having a u-shaped housing, flanges, and a spring loaded counter-pressure plate for storing the at least one note;

a crank arm affixed to a rotary motor; and a telescoping drive member directly actuated by the crank arm and attached to a pusher plate, for pushing the at least one note into the storage box.

11. The apparatus of claim 10, wherein the telescoping drive member comprises at least two telescoping portions, and wherein at least one rail supports and guides at least one of the telescoping portions in one axis perpendicular to the axis of movement of the note.

12. The apparatus of claim 11, wherein the at least one rail is located in the center of the movement axis of the telescoping drive member or the telescoping support member.

13. The apparatus of claim 11, wherein the telescoping portions are configured with fingers for engaging one another and causing movement of at least one of the telescoping portions.

14. The apparatus of claim 13, wherein the fingers are further configured to confine movement of the telescoping portions to a plane perpendicular to the longitudinal axis of the shaft.

15. The apparatus of claim 10, further comprising a telescoping support member for supporting the telescoping drive member, wherein the telescoping drive member rides in the telescoping support member, and wherein the telescoping drive member engages with and pushes the telescoping support member after the crank arm moves the telescoping drive member a predetermined distance.

16. The apparatus of claim 15, further comprising a fixed support member attached to a validator frame of a currency validator, wherein the telescoping support member is configured to ride in the fixed support member.

17. The apparatus of claim 16, further comprising a stop finger attached to the fixed support member for limiting the distance of travel of the telescoping support member.

18. The apparatus of claim 10, wherein the telescoping drive member comprises a drive plate, and wherein the telescoping drive member actuates the pusher plate via the drive plate.

19. The apparatus of claim 10, wherein the telescoping drive member comprises a groove for receiving a pin attached to the crank arm.

20. An apparatus for stacking a note in a note validator having a storage box, the apparatus comprising:

a motor having a rotary shaft;

a crank arm coupled to the shaft, the crank arm having a protruding member;

a telescoping drive member having a proximal end, an intermediate portion, and a distal end, wherein the proximal end comprises a groove for receiving the protruding member;

a plate coupled to the distal end, wherein the plate and the telescoping drive member are positioned substantially perpendicular to one another;

wherein the crank arm causes the telescoping drive member to move linearly in a plane perpendicular to the longitudinal axis of the shaft; and wherein the telescoping drive member moves the plate for pushing the note into the storage box.

21. The apparatus of claim 20, further comprising a telescoping support member having at least one rail for supporting and guiding the telescoping drive member, wherein the at least one rail guides the telescoping drive member in one axis perpendicular to the axis of movement of the note.

22. The apparatus of claim 21, wherein the at least one rail is located in the center of the movement axis of the telescoping drive member.

23. The apparatus of claim 21, wherein the telescoping drive member and the telescoping support member are configured with fingers for engaging one another and causing movement of the telescoping support member.

24. The apparatus of claim 23, wherein the fingers are further configured to confine movement of the telescoping drive member to a plane perpendicular to the longitudinal axis of the shaft.

25. The apparatus of claim 20, further comprising a telescoping support member for supporting the telescoping drive member, wherein the telescoping drive member rides in the telescoping support member, and wherein the telescoping drive member engages with and pushes the telescoping support member after the crank arm moves the telescoping drive member a predetermined distance.

26. The apparatus of claim 25, further comprising a fixed support member attached to a validator frame of the note validator, wherein the telescoping support member is configured to ride in the fixed support member.

27. The apparatus of claim 26, further comprising a stop finger attached to the fixed support member for limiting the distance of travel of the telescoping support member.

28. The apparatus of claim 26, wherein the fixed support member comprises at least one rail for supporting and guiding the telescoping support member.

29. The apparatus of claim 20, wherein the distal end of the telescoping drive member comprises a drive plate, and wherein the telescoping drive member actuates the pusher plate via the drive plate.

30. An apparatus for stacking a note in a note validator having a frame and a storage box, the apparatus comprising:

a motor having a rotary shaft;

a crank arm coupled to the shaft, the crank arm having a protruding member;

a telescoping drive member having a proximal end, an intermediate portion, and a distal end, wherein the proximal end of the telescoping drive member contains a first groove for receiving the protruding member, wherein the first groove is perpendicular to a line defined by the shortest distance between the proximal end and the distal end, and wherein the telescoping drive member contains a second groove that runs substantially from the proximal end to the distal end;

a support member, substantially located inside the frame, having at least one rail configured to couple with the second groove for supporting and guiding the telescoping drive member;

a plate coupled to the distal end, wherein the plate and the telescoping drive member are positioned substantially perpendicular to one another;

wherein the crank arm causes the telescoping drive member to move linearly in a plane perpendicular to the longitudinal axis of the shaft; and wherein the telescoping drive member moves the plate for pushing the note into the storage box.

31. The apparatus of claim 30, wherein the at least one rail is located in the center of the movement axis of the telescoping drive member.

32. The apparatus of claim 30, wherein the distal end of the telescoping drive member comprises a drive plate, and wherein the telescoping drive member actuates the pusher plate via the drive plate.

33. An apparatus for stacking a note in a note validator having a storage box, the apparatus comprising:

means for rotating a shaft;

means coupled to the shaft for converting the circular motion of the shaft to reciprocating linear motion;

telescoping drive means configured to engage with the means for converting, wherein the means for converting causes the telescoping drive means to move linearly in a plane perpendicular to the longitudinal axis of the shaft; and means actuated by the telescoping means for pushing the note into the storage box.

34. The apparatus of claim 33, further comprising a telescoping support means having at least one rail for supporting and guiding the telescoping drive means, wherein the at least one rail guides the telescoping drive means in one axis perpendicular to the axis of movement of the note.

35. The apparatus of claim 34, wherein the at least one rail is located in the center of the movement axis of the telescoping drive means.

36. The apparatus of claim 34, wherein the telescoping drive means and the telescoping support means are configured with fingers for engaging one another and causing movement of the telescoping support means.

37. The apparatus of claim 36, wherein the fingers are further configured to confine movement of the telescoping drive means to a plane perpendicular to the longitudinal axis of the shaft.

38. The apparatus of claim 33, further comprising telescoping support means for supporting the telescoping drive means, wherein the telescoping drive means rides in the telescoping support means, and wherein the telescoping drive means engages with and pushes the telescoping support means after the means for converting the circular motion of the shaft to reciprocating motion moves the telescoping drive means a predetermined distance.

39. The apparatus of claim 38, further comprising a fixed support means attached to a validator frame of the note validator, wherein the telescoping support means is configured to ride in the fixed support means.

40. The apparatus of claim 39, further comprising a stop finger attached to the fixed support means for limiting the distance of travel of the telescoping support means.

41. The apparatus of claim 39, wherein the fixed support means comprises at least one rail for supporting and guiding the telescoping support means.

42. The apparatus of claim 33, wherein the telescoping drive means comprises a drive plate, and wherein the telescoping drive means actuates the means for pushing the note into the storage box via the drive plate.

* * * * *